US010053341B2

(12) United States Patent
Schroeder et al.

(10) Patent No.: US 10,053,341 B2
(45) Date of Patent: Aug. 21, 2018

(54) DEVICE FOR CONTROLLING CRANE STOP ANGLE

(71) Applicant: D & R CRANE, INC., El Cajon, CA (US)

(72) Inventors: James Henry Schroeder, El Cajon, CA (US); Byron R. Patrick, El Cajon, CA (US)

(73) Assignee: D & R CRANE, INC., El Cajon, CA (US)

( * ) Notice: Subject to any disclaimer, the term of this patent is extended or adjusted under 35 U.S.C. 154(b) by 426 days.

(21) Appl. No.: 14/920,692

(22) Filed: Oct. 22, 2015

(65) Prior Publication Data

US 2017/0113905 A1 Apr. 27, 2017

(51) Int. Cl.
*B66C 23/94* (2006.01)

(52) U.S. Cl.
CPC ..... *B66C 23/94* (2013.01); *Y10T 403/32557* (2015.01)

(58) Field of Classification Search
CPC ..... B66C 23/94; B66C 23/00; B66C 23/02; B66C 23/022; B66C 23/16; B66C 23/163; B66C 23/166; B66C 23/62; Y10T 403/32557; Y10T 403/32591; Y10T 403/4614; Y10T 403/4617; Y10T 403/4611; Y10T 403/648
USPC ..... 212/292
See application file for complete search history.

(56) References Cited

U.S. PATENT DOCUMENTS 935,413 A * 9/1909 Ryan ..... B63B 23/18 114/374
947,029 A * 1/1910 Sasgen ..... B66C 23/708 212/292
994,324 A * 6/1911 Maul ..... B66C 23/708 212/292
1,130,766 A * 3/1915 Sasgen ..... B66C 23/708 212/195
1,563,406 A * 12/1925 Skinner ..... F16L 41/12 285/197
1,616,797 A * 2/1927 Greene ..... H05B 7/103 174/138 D
1,650,656 A * 11/1927 Sasgen ..... B66C 23/202 212/175
3,664,515 A * 5/1972 Orendorff ..... B66C 23/94 104/47
3,954,188 A * 5/1976 Boyle ..... B25J 9/101 414/732

(Continued)

*Primary Examiner* — Josh Skroupa
*Assistant Examiner* — Matthew R McMahon
(74) *Attorney, Agent, or Firm* — Procopio, Cory, Hargreaves & Savitch LLP

(57) ABSTRACT

This disclosure provides a system and method for limiting a swing angle of a jib crane, the jib crane having a jib rotatably mounted to a mast. The device can have a collar having a collar height and a collar width, the collar being configured to be fit to the mast at a stop height. The device can also have one or more stopping tabs enagagable with the collar and configured to be positioned on the collar at one or more points about a circumference of the mast. The stop height can place the one or more stopping tabs in a position coincident with the jib to interfere with the swing angle of the jib. The method can use the device to limit the angle through which the jibe crane can swing unimpeded.

12 Claims, 6 Drawing Sheets

(56) References Cited

U.S. PATENT DOCUMENTS

| | | | | | |
|---|---|---|---|---|---|
| 4,065,846 | A * | 1/1978 | Leonard, Jr. | B23K 9/0286 | 219/60 A |
| 4,191,301 | A * | 3/1980 | Hickman | B66C 23/84 | 182/19 |
| 4,648,388 | A * | 3/1987 | Steffee | A61B 17/7005 | 248/316.6 |
| 4,828,094 | A * | 5/1989 | Torii | B25J 9/101 | 192/139 |
| 5,261,633 | A * | 11/1993 | Mastro | F16L 3/18 | 248/68.1 |
| 5,281,042 | A * | 1/1994 | Belrose | F16L 3/1091 | 248/74.4 |
| 5,393,193 | A * | 2/1995 | Dagg | B60P 1/5433 | 188/72.8 |
| 5,402,898 | A * | 4/1995 | Lute | B66C 23/62 | 212/175 |
| 5,655,741 | A * | 8/1997 | Watkins | F16M 11/08 | 248/125.9 |
| 7,134,357 | B2 * | 11/2006 | Gilbert | G05G 5/04 | 74/492 |
| 7,150,438 | B2 * | 12/2006 | Schaty | F16L 3/1008 | 248/74.1 |
| 7,370,769 | B2 * | 5/2008 | Picard | B60P 1/5433 | 212/292 |
| 7,467,767 | B2 * | 12/2008 | Miles | F16L 3/1008 | 174/42 |
| 9,394,145 | B2 * | 7/2016 | Yada | B66C 1/101 | |
| 9,683,532 | B2 * | 6/2017 | Rehwald | F02M 55/025 | |
| 2008/0246279 | A1 * | 10/2008 | van Walraven | F16L 3/1016 | 285/420 |
| 2014/0255090 | A1 * | 9/2014 | Oravits | F16B 2/10 | 403/338 |

* cited by examiner

DEVICE FOR CONTROLLING CRANE STOP ANGLE

BACKGROUND

Technological Field

This disclosure relates to cranes and crane safety components and to crane stops for limiting a swing angle of a crane.

Related Art

Cranes can be built in an array of sizes for various implementations. Cranes can be used for moving large or unwieldy objects in an array of different environments. Large cranes can be used in the construction or transportation industry for loading ships or moving large amounts of materials at a construction site or loading dock, for example. One such type of crane is a jib crane. Jib cranes are used in a wide variety of applications, such as a workshop or garage, and can be relatively small in comparison to the larger tower, overhead, or railroad cranes. On the other hand, large high capacity jib cranes can be found in foundries, heavy equipment manufacturing plants, and in the aerospace, and high technology industries.

SUMMARY

In general, this disclosure describes a device and method for restricting a swing angle of a jib crane. More particularly, this disclosure describes implementation of a mechanical stop for use with jib cranes that can be used to confine or limit the azimuth through which a jib crane can swing. The methods and devices of this disclosure each have several innovative aspects, no single one of which is solely responsible for the desirable attributes disclosed herein.

One aspect of the disclosure provides a device for limiting a swing angle of a jib crane, the jib crane having a jib rotatably mounted to a mast. The device can have a collar having a collar height and a collar width, the collar being configured to be fit to the mast at a stop height. The device can also have one or more stopping tabs enagagable with the collar and configured to be positioned on the collar at one or more points about a circumference of the mast. The stop height can place the one or more stopping tabs in a position coincident with the jib to interfere with the swing angle of the jib.

Another aspect of the disclosure provides a method for limiting a swing angle of a jib crane, the jib crane having a jib rotatably mounted to a mast. The method can include determining a stop height on the mast coincident with a portion of the jib. The method can also include securing a collar at the stop height on the mast, the collar configured to be slidably fit around the mast engaging one or more stopping tabs with the collar at one or more points about a circumference of the mast, the stop height placing the one or more stopping tabs in a position coincident with the jib. The method can also include limiting an effective swing angle of the jib based on the one or more points.

Another aspect of the disclosure provides a device for limiting a swing angle of a jib crane, the jib crane having a jib rotatably mounted to a mast. The device can have a first collar portion having a first joint end and a first flange end, the first flange end having a first flange disposed orthogonally to the first flange end. The device can also have a second collar portion having a second joint end and a second flange end, the second flange end having a second flange disposed orthogonally to the second flange end, the first collar portion and the second collar portion having a semicircular shape. The device can also have a joining plate engageable with the first joint end and the second joint end wherein the first collar portion and the second collar portion are configured to surround the mast to form a collar when engaged with the joining plate. The device can also have one or more stopping tabs configured to engage with the collar and be positioned at one or more points around the collar, the one or more stopping tabs being positioned coincident with a movement of the jib and limiting the movement of the jib to an angle determined by the stopping tabs.

Other features and advantages of the present disclosure should be apparent from the following description which illustrates, by way of example, aspects of the disclosure.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in a simplified form for brevity of description.

Figure 1:
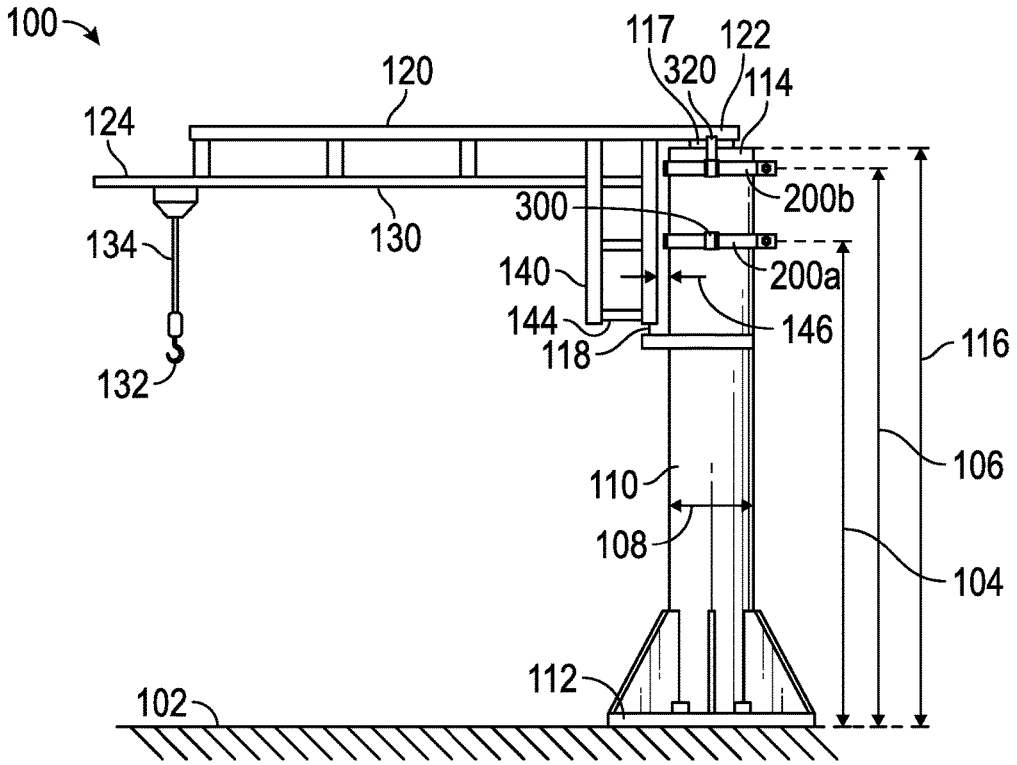
FIG. 1 is an elevation view of a jib crane.

FIG. 1 is an elevation view of a jib crane. A jib crane 100 can have a mast 110. The mast 110 can be a vertical support structure of the jib crane 100. The mast 110 can have a base 112 and a mast head 114 separated by a height 116. The base 112 can be bolted or otherwise affixed to a ground surface 102 of a workshop, a garage, or other location. In some embodiments, the mast 110 can have a circular cross section having an outer diameter 108. In some other embodiments, the mast 110 can have a rectangular, square, or other shaped cross section.

The jib crane 100 can also have a jib 120. The jib 120 can have a proximal end 122 and a distal end 124. As described herein the proximal end 122 is the end of the jib 120 closest to the mast 110 and the mast head 114. The distal end 124 is the end of the jib 120 farthest from the mast 110. The jib 120 can have a boom 130 that extends in a generally horizontal direction away from the mast 110 and supports a hook 132 and associated tackle 134 for hoisting a load. In some embodiments the associated tackle can include a trolley (not shown) for moving the tackle along the boom 130. The jib 120 can also have a support 140 that reinforces and provides support to the boom 130 and the trolley, the hook 132, and the tackle 134. The support 140 can be a lattice structure as shown or another suitable structure that provides support to the boom 130. The support 140 can be separated horizontally from the mast 110 by a short distance indicated by the arrows 146 (distance 146). Such a distance may be only a few inches, for example. This is described in more detail below.

The jib crane 100 can have a span that describes the distance (not shown) from the center of the mast head 114 (e.g., at the upper bearing 117) to the distal end 124 of the boom 130. The span can also describe the distance away from the center of the mast head 114 that the tackle 134 and hook 132 can slide via the trolley along the jib 120.

The proximal end 122 of the jib 120 can be rotatably mounted to the mast head 114 via an upper bearing 117. A bottom 144 of the support 140 can also be rotatably mounted to the mast via a lower bearing 118. The upper bearing 117 and the lower bearing 118 can allow the jib 120 to rotate such that the jib 120 can rotate an angular distance around the mast 110 (see FIG. 5A, FIG. 5B). In some examples, certain combinations of the upper bearing 117 and the lower bearing 118 can allow the jib 120 to rotate 360 degrees about the mast 110. In some other examples, the structure and position of the upper bearing 117 and the lower bearing 118 can further limit the rotation of the jib 120 to angles less than a full 360 rotation.

In some embodiments, the jib crane 100 can be installed in a workshop, garage, a manufacturing facility, or other environment having limited space. For example, the jib crane 100 may be installed in a corner of such a space. This may result in certain spatial constraints that must be observed by a crane operator to avoid damage to other surrounding equipment or structures. For example, if the jib crane 100 that can swing 360 degrees is installed in a corner of a workshop, the space available in such a place may be limited by adjacent walls, thus allowing the jib 120 to rotate only 90 degrees, for example. Accordingly, the crane operator should only allow the crane to swing within the confined of the 90 degree corner to avoid damaging the walls when hoisting or moving a heavy load with the crane. In another example, more than one jib crane 100 can be installed in proximity to one another. Accordingly, there may be many reasons to restrict the rotation of the jib 120 to avoid damage to other structures or equipment. It should be noted that the jib crane 100 may not be drawn to scale. Certain features of the jib crane may also vary slightly depending on design.

Figure 4B:
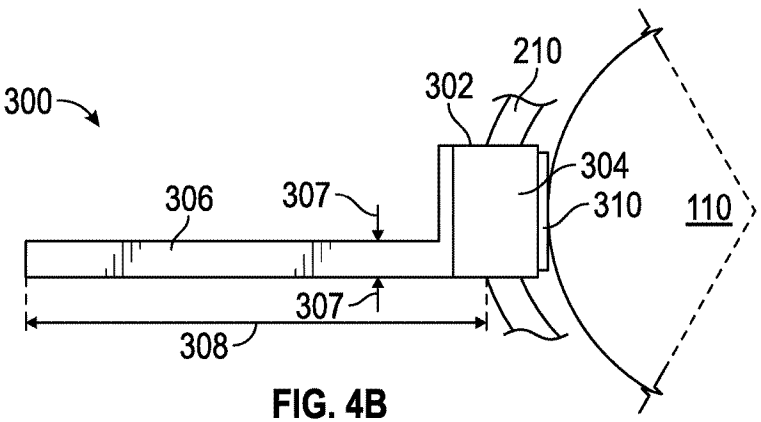
FIG. 4B is a plan view of the horizontal stopping tab of FIG. 3.

The jib crane 100 can include a jib stop assembly 200. In FIG. 1 a jib stop assembly 200*a* configured with a horizontal stopping tab 300 and a jib stop assembly 200*b* configured with a vertical stopping tab 320 are shown. As used herein, the jib stop assemblies 200*a*, 200*b* can be collectively referred to herein as jib stop assemblies 200. The jib stop assemblies 200 can be used to restrict the rotation of the jib 120. As shown in this figure, the jib stop assembly 200*a* is positioned on the mast 110 at a stop height 104. Similarly the jib stop assembly 200*b* is positioned on the mast 110 at a height 106. As will be discussed more thoroughly below, the jib stop assemblies 200 can use stopping tabs (FIG. 4A-FIG. 4C) to interrupt or otherwise limit the rotational movement of the jib 120. For example, the jib stop assembly 200*a* can use the horizontal stopping tab (horizontal tab) 300 that can be positioned to contact the support 140 at a desired rotational limit (FIG. 5A). Similarly, the jib stop assembly 200*b* can use the vertical stopping tab (vertical tab) 320 that can be positioned to contact a portion of the proximal end 122 of the jib 120 at a desired rotational limit (FIG. 5B). While the combination of both the jib stop assembly 200*a* and the jib stop assembly 200*b* are shown here for convenience of description, both are not required for proper operation. In some embodiments, only one jib stop assembly 200*a* or one jib stop assembly 200*b* may be required.

Figure 2:
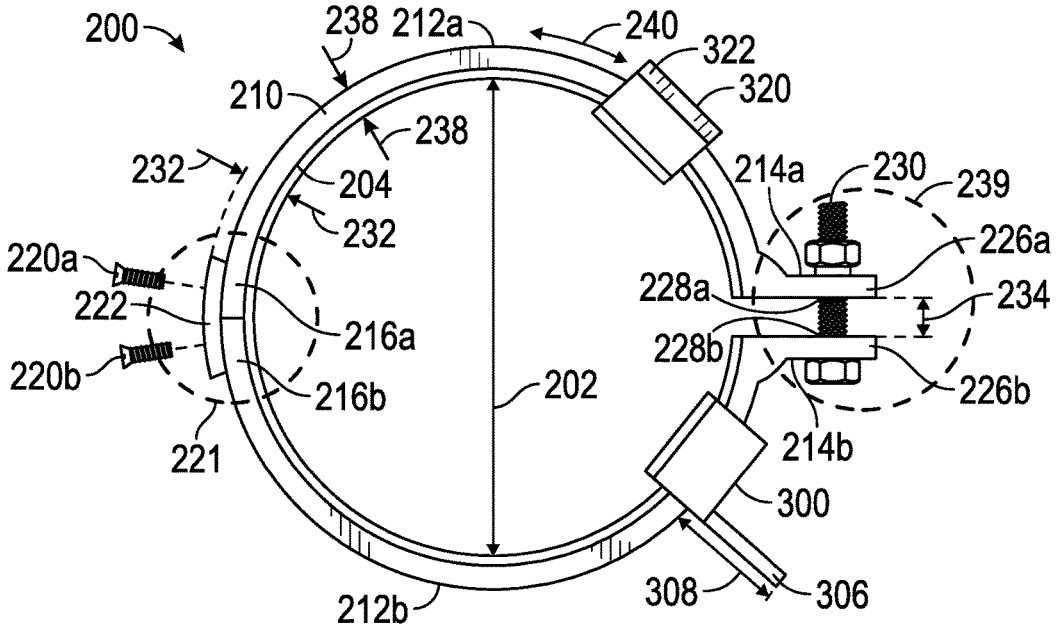
FIG. 2 is a plan view of the jib stop assembly of FIG. 1.

FIG. 2 is a plan view of a jib stop assembly of FIG. 1 having a vertical stop and a horizontal stop. The jib stop assemblies 200 can have a collar 210. The collar 210 can have an inner diameter 202 slightly larger than the outer diameter 108 of the mast 110. In some other embodiments, the collar 210 can have an inner diameter 202 approximately equal to the outer diameter 108 of the mast 110. As will be described below, the inner diameter 202 can be variable allowing it to be moved or repositioned on the mast 110 or removed as needed. Alternatively, it can be fixedly attached to the mast 110, for example, by welding.

The collar 210 can have a first collar portion 212*a* and a second collar portion 212*b* that each have a clamp end 214 (shown as clamp ends 214*a*, 214*b*). The first collar portion 212*a* and the second collar portion 212*b* can be formed as mirror images each formed with a curvature that matches that of the mast 110 to which they can be fitted. In some embodiments, the first collar portion 212*a* and the second collar portion 212*b* can be identically formed. Alternatively, the collar 210 can be formed as a single or unitary piece.

In some embodiments, the first collar portion 212*a* and the second collar portion 212*b* can also each have a joint end 216 (shown as joint ends 216*a*, 216*b*). The joint ends 216, and therefore the first collar portion 212*a* and the second collar portion 212*b*, can be joined by a joining mechanism 221. The joining mechanism 221 can connect or otherwise secure the first collar portion 212*a* and the second collar portion 212*b* to form the collar 210. In some embodiments, the joining mechanism 221 can be a joining plate 222 that can be joined using fasteners 220*a*, 220*b*, for example. The joint ends 216 can each have one or more apertures arranged to align with corresponding apertures in the joining plate 222. The apertures in the joining plate and the apertures in the joint ends 216 can be internally threaded and sized to accept the fasteners 220. The fasteners 220 can have external threads formed to mate with the internal threads of the apertures in the joining plate 222 and the apertures in the joint ends 216. Two fasteners 220 are shown as fasteners 220*a*, 220*b*. The fasteners 220 can be bolts or other appropriate fastening means. In some embodiments, for example, the fasteners 220 can be half-inch steel bolts. In other embodiments, the size of the fasteners 220 can be dictated by the size of the jib crane 100 and increased loads associated with the larger jib crane 100. In some embodiments, the fasteners 220 can be countersunk into the joining mechanism 221, for example, the joining plate 222. Countersinking the fasteners 220 can minimize the profile of the joining plate 222 providing clearance to the support 140 (FIG. 1) as the jib 120 is rotated. In some embodiments, the joining mechanism 221 can implement rivets or other fasteners to secure the first collar portion 212*a* to the second collar portion 212*b* at the joint ends 216. In some other embodiments, the joining mechanism 221 can be another kind of mechanical or interference coupling that does not require the fasteners 220.

The jib stop assembly 200 can also have a compression mechanism 239 (indicated in dashed lines) for compressing the clamp ends 214 toward each other to decrease the inner diameter 202 of the collar 210 and secure the jib stop assembly 200 to the mast 110.

In some embodiments, the compression mechanism 239 can have a clamp tab 226 formed at the clamp ends 214. In some embodiments, the first collar portion 212*a* can have the clamp tab 226*a* and the second collar portion 212*b* can have the clamp tab 226*b*. The clamp tabs 226 can also be referred to herein as flanges. The compression mechanism 239 can also have a clamp fastener 230. In some embodiments, the clamp fastener 230 can be for example, a bolt, nut, and washer assembly used to tighten the collar 210 and secure the jib stop assemblies 200 around the mast 110. In another embodiment the clamp fastener 230 can comprise a quick release or lever-activated compression mechanism 239. Each of the clamp tabs 226 can have an aperture 228 (shown as apertures 228*a*, 228*b*) sized to receive a clamp fastener 230. The clamp fastener 230 can, for example, be tightened in order to compress the flanges of the compression mechanism 239 together.

In some embodiments, the first collar portion 212*a* and the second collar portion 212*b* can be formed of a metallic material such as a metal strap band or multiple pieces of metal welded or otherwise joined.

In use, each of the first collar portion 212*a* and the second collar portion 212*b* can be placed in position at the stop height 104 or the height 106 as needed. The joining mechanism 221, or the joining plate 222, can then be positioned to secure each of the joint ends 216 to form the collar 210, surrounding the mast 110. In an embodiment using a single joining plate 222, the apertures in the joining plate 222 can be aligned with the respective apertures in the joint ends 216 to receive the fasteners 220. The fasteners 220 can be inserted through the joining plate 222 and the joint ends 216 and tightened in place, with the first collar portion 212*a* and the second collar portion 212*b* surrounding the mast 110 to form the collar 210. The compression mechanism 239 can then be tightened or otherwise compressed to secure the jib stop assembly 200 to the mast 110. In at least one embodiment, the clamp fastener 230 can be inserted through apertures in the clamp tabs 226. The clamp fastener 230 can then be tightened to decrease a distance 234 between the clamp ends 214. As the compression mechanism 239 is tightened, the clamp ends 214 can be compressed toward one another decreasing the inner diameter 202. This action can tighten the collar 210 about the mast 110 at a desired stop height 104, 106 and rotational position. In some embodiments a pad 204 can further be inserted between the collar 210 and a surface of the mast 110. The pad 204 can have a thickness that can accommodate any irregularities in the surface of the mast 110 where the jib stop assembly 200 is installed. The pad 204 can also provide an amount of friction that can prevent the jib stop assembly 200 from rotating around the mast 110 or moving out of position once the clamp fastener 230 is tightened as desired. For example, the rubber may have a thickness of ⅛ to 3⁄16 inches. In some embodiments, the pad 204 can be a piece of rubber applied to the inner surface of the collar 210. In some other embodiments, the pad 204 can be affixed to an inner surface of the first collar portion 212*a* and the second collar portion 212*b* independently such that it will be in contact with the mast 110 in use.

In some embodiments, the collar 210 and each of its subcomponents can be formed of a metallic material or alloy. In some embodiments, the first collar portions 212*a* and the second collar portion 212*b* can be formed from a metal strap band and bent to form the clamp ends 214 and the clamp tabs 226. In some other embodiments, the first collar portion 212*a* and the second collar portion 212*b* can be forged or otherwise welded together and formed from smaller portions of metal. In some other embodiments, the collar can be formed from a portion of pipe. In still other embodiments, the collar 210 and the other components of the jib stop assemblies 200*a*, 200*b* can be formed from 50 series steel, 836 steel, or other similar or suitable materials for the application.

The collar 210 can have a collar thickness 238 (indicated by arrows 238). The collar thickness 238 can be approximately one quarter inch to one half inch. In some embodiments, the collar thickness 238 can be more than one half inch. In other embodiments, the collar thickness 238 can be three quarters of an inch or more, depending on the strength of the materials required. In some embodiments, a combined thickness of the joining plate 222, the fasteners 220, the collar 210, and the pad 204 is described by the arrows 232 (combined thickness 232). In some embodiments, the combined thickness 232 should be less than the distance 146 (FIG. 1) between the mast and the support 140. This will prevent unwanted interference between the jib stops 200 and the support 140.

Figure 3:
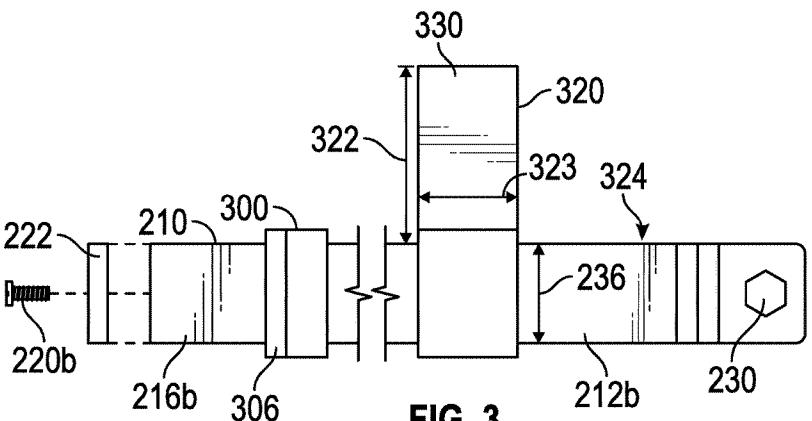
FIG. 3 is an elevation view of the jib stop assembly of FIG. 1.
Figure 4C:
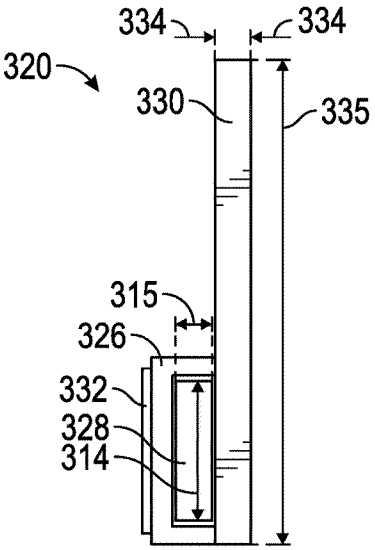
FIG. 4C is an elevation view of the vertical stopping tab of FIG. 3.

The jib stop assembly 200 can also have one or more stopping tabs, such as the horizontal stopping tab 300 (FIG. 4A, FIG. 4B) or the vertical stopping tab 320 (FIG. 3, FIG. 4C). One or more of each of the horizontal stopping tab 300 and the vertical stopping tab 320 can be used in various configurations as required by the jib crane 100 installation. The horizontal stopping tab 300 and the vertical stopping tab 320 can each be moved horizontally along the collar 210 (e.g., the first collar portion 212*a* and the second collar portion 212*b*) to a desired position in a direction shown by the double-ended arrow 240. As shown, the horizontal stopping tab 300 has a tab arm 306 that extends a distance 308 away from the collar 210 in use. In a similar fashion, the vertical stopping tab 320 has a tab arm 330 that extends away from the collar vertically along the mast 110 (out of the page). These aspects are described below in connection with FIG. 3 through FIG. 4C.

The horizontal stopping tab 300 and the vertical stopping tab 320 are shown together in this figure for convenience of description. In some embodiments, however, the stopping tabs (e.g., the horizontal stopping tabs 300 and the vertical stopping tabs 320) are used in like pairs. For example, two horizontal stopping tabs 300 can be used for the jib stop assembly 200*a* (FIG. 1). Similarly, two vertical stopping tabs 320 can be used on the jib stop assembly 200*b* (FIG. 1). In some embodiments, both a horizontal stopping tab 300 and a vertical stopping tab 320 can be used in conjunction depending on the stop height 104 selected. For example, one horizontal stopping tab 300 and one vertical stopping tab 320 can be used at a stop height 106 near the mast head 114. In such an arrangement, the vertical stopping tab 320 can be positioned to contact the jib 120 while the horizontal stopping tab 300 can still be used to contact the support 140.

FIG. 3 is an elevation view of an embodiment of the jib stop assembly of FIG. 2. The jib stop assemblies 200 can have one or more stopping tabs, such as the horizontal stopping tab 300 and the vertical stopping tab 320. The joint ends 216 of the first collar portion 212*a* or the second collar portion 212*b* can be passed through one or more of the stopping tabs 300, 320. This is described in connection with FIG. 4A and FIG. 4C. In FIG. 3, the tab arm 306 of the horizontal stopping tab 300 extends horizontally away from the mast 110 the distance 308 (FIG. 2), out of the page. The vertical stopping tab 320 has a vertical tab arm 330 that extends a distance 322 away from a top edge 324 of the collar 210. The tab arm can have a width 323. The collar 210 can further have a collar height 236. As with the collar 210 and its subcomponents, the horizontal stopping tab 300 and the vertical stopping tab 320 can be formed of a metallic material, forged into a unitary component, or welded or otherwise formed from smaller pieces.

In some embodiments, for example, the collar height 236 can be one to three inches, depending on the application and the size and capacity of the jib crane 100. Similarly, the distance 308 can measure one to four or more inches, depending on the application, size, and span of the jib crane 100. The distance 322 can also measure from one inch to five or more inches. The distance 308 and the distance 322 for example can vary by application. As different manufacturers have different sizes and capacities of jib cranes 100, the dimensions of the jib stop assemblies 200 can vary accordingly. These dimensions, and the other exemplary dimensions that follow, are provided by way of example and not limitation.

The joining mechanism 221 is shown as the joining plate 222 exploded from the left-hand side of FIG. 3. The joining plate 222, as noted above, can have apertures formed to accept the fasteners 220. Only the fastener 220*b* is shown in this view. The fasteners 220 can be used to secure the joining mechanism (e.g., the joining plate 222) to the first collar portion 212*a* and the second collar portion 212*b* to form the collar 210.

Figure 4A:
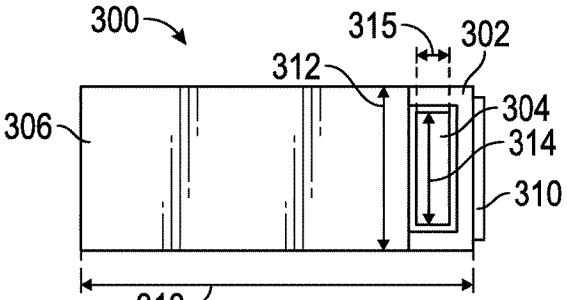
FIG. 4A is an elevation view of the horizontal stopping tab of FIG. 3.
Figure 5A:
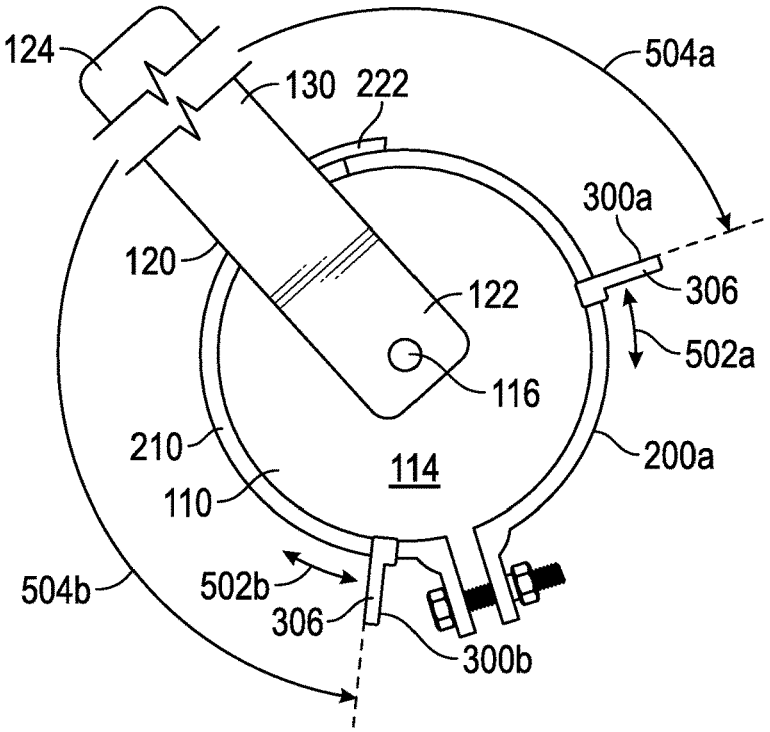
FIG. 5A is a plan view of a jib crane using an embodiment of the jib stop assembly of FIG. 3.
Figure 5B:
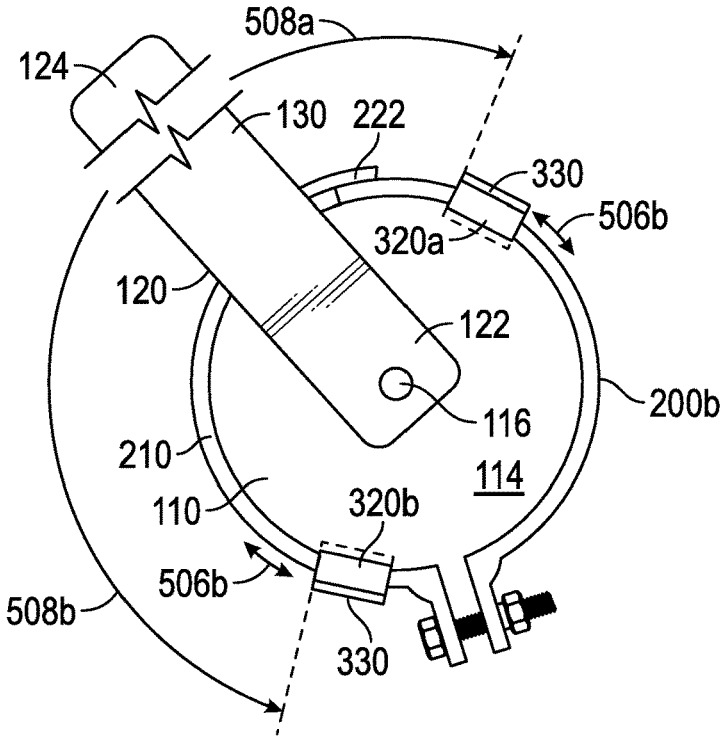
FIG. 5B is a plan view of a jib crane using an embodiment of the jib stop assembly of FIG. 3.

FIG. 4A is an elevation view of the horizontal stopping tab of FIG. 3. FIG. 4B is a plan view of the horizontal stopping tab 300 of FIG. 3. FIG. 4A and FIG. 4B are described in conjunction. In some embodiments, the horizontal stopping tab 300 can have overall dimensions described by a height 312 and a width 313. In use, the width 313 and more particularly the distance 308 can place the horizontal tab arm in a position to interrupt the movement of the jib 120. For example, the height 312 can be one half to two inches. In some embodiments, the height 312 can also exceed two inches, as needed. In some other embodiments, the width 313 can measure one to three inches. In some embodiments, the width 313 can exceed three inches, depending on application.

The horizontal tab arm 306 can have a thickness indicated by arrows 307 (tab thickness 307). The tab thickness 307 can be selected for ease of manufacture and structural stability for use with the jib crane 100. Accordingly, the tab thickness 307 can be approximately one quarter inch to one half inch. In some embodiments, the tab thickness 307 can be more than one half inch, depending on the strength of the materials required.

The horizontal stopping tab 300 can also have tab body 302 having an aperture 304. The aperture 304 can have a height 314 and a width 315 and be sized to receive the collar 210 in a clearance fit. The clearance fit can allow one of the joining ends 216 to extend through the aperture 304 and allow the horizontal stopping tab 300 to be moved in the direction 240 (FIG. 2) as needed.

Referring to FIG. 4B, the portion of the collar 210 shown in this view can be, for example, the second collar portion 212*b*. The joint end 216*b* can be inserted through the aperture 304 and the horizontal stopping tab 300 positioned on the collar 210 as required prior to installation on the mast 110. The horizontal tab arm 306 can extend the distance 308 away from the collar 210 in use. The horizontal stopping tab 300 can also have a tab pad 310 affixed or placed on the portion of the tab body 302 in contact with the mast. Similar to the pad 204, the pad 310 can provide friction to maintain the position of the horizontal stopping tab 300 once the compression mechanism 239 (e.g., the clamp fastener 230) is tightened in place.

FIG. 4C is an elevation view of the vertical stopping tab of FIG. 3. The vertical stopping tab 320 can have a tab body 326 having an aperture 328. The aperture 328 can have a height 314 and a width 315 also be sized to accept the collar (e.g., the first collar portion 212*a* or the second collar portion 212*b*) in a clearance fit, similar to the horizontal stopping tab 300. Similar to above, the vertical stopping tab 320 can have the vertical tab arm 330 that extends the distance 322 (FIG. 2) away from the top edge 324 of the collar 210. The vertical stopping tab 320 can also have a thickness 334 and a height 335, in addition to the width 323 (FIG. 3). The height 335 can be larger a combination of the collar height 236 of the collar 210 and the distance 322 to account for the size of the tab body 326. The height 335 can be approximately one to four or more inches. The width 323 can be one to two or more inches. Further, similar to above, the thickness 334 can be one-half niche or more, depending on the application and size of the jib crane 100.

In some embodiments, the vertical stopping tab 320 can also have a tab pad 332 similar to the tab pad 310. The tab pad 332 can be a portion of rubber (e.g., ⅛ to 3/16 inches) affixed to the tab body 326 or fitted between the mast 110 and the vertical stopping tab 320.

The tab pad 332 also provides additional security by compressing between the vertical tab 332 and the mast 110 when tightening the clamp fastener 230. Accordingly, the tab pad 332 can accommodate certain irregularities on the surface of the mast 110 and provide increased friction preventing the collar from rotating on the mast 110.

In some embodiments, the dimensions of the jib stop assemblies 200 and their various components can vary depending on the load-bearing capacity and the span of the jib crane 100. Accordingly, in larger jib cranes 100, the size and dimensions of the jib 120, the support 140, the distance 146, among other dimensions can all dictate variations in dimensions of the components of the jib stop assembly 200*a*, 200*b*. In particular, the collar height 236 and the collar thickness 238 of the collar 210; the tab thickness 307, the height 312, and the width 313 of the horizontal stopping tab 300; and the thickness 334, the height 335, and the width 323 of the vertical stopping tab 320, can vary with application and the size of the jib crane 100 and its components.

FIG. 5A is a plan view of a jib crane, such as the one depicted in FIG. 1, using an embodiment of the horizontal jib stop of FIG. 3. FIG. 5A is a view looking down on the mast head 114 of the jib crane 100. The jib stop assembly 200*a* can be installed on the mast 110 using one or more of the horizontal stopping tabs 300 (e.g., a stopping tab). Two horizontal stopping tabs 300 are shown, labeled horizontal stopping tab 300*a* and horizontal stopping tab 300*b*. The horizontal stopping tabs 300 can be positioned or repositioned in the direction indicated by the double-ended arrows 502 (502*a*, 502*b*) as needed along the length of the collar 210.

Referring briefly back to FIG. 1, the jib stop assembly 200*a* can be affixed at the stop height 104. The stop height 104 can describe the distance from the ground surface 102 to the height along the mast 110 at which the jib stop assembly 200*a* is affixed. Such a stop height 104 can place the horizontal stopping tabs 300 in a plane coincident with the support 140 (FIG. 1). Additionally, the horizontal stopping tabs 300*a*, 300*b* extend away from the mast 110 a sufficient distance to contact the support 140 when the jib swings. In some embodiments, the jib 120, along with the boom 130, can swing unimpeded through an arc described by the arrows 504*a*, 504*b* (collectively arrows 504). As the jib 120 moves in the direction of the arrows 504, the support 140 (FIG. 1) can meet one of the two horizontal stopping tabs 300 depending on the direction the jib 120 swings. Accordingly, the placement of the horizontal stopping tabs 300 can define the effective angle through which the jib 120 can have unimpeded movement. In this way, the jib stop assembly 200*a*, and more particularly, the horizontal stopping tabs 300 can interfere with jib 120 and effectively limit the angle through which the jib 120 can swing. Thus the position of the horizontal stopping tabs 300 on the jib stop assembly 200 can help protect nearby equipment or structures.

FIG. 5B is a plan view of a jib crane, such as the one depicted in FIG. 1, using an embodiment of the vertical jib stop of FIG. 3. FIG. 5B is a view looking down on the mast head 114 of the jib crane 100, similar to FIG. 5A. In some embodiments, the jib stop assembly 200*b* can be installed on the mast 110 using one or more of the vertical stopping tabs 320. Two vertical tabs 320 are shown, labeled vertical stopping tab 320*a* and vertical stopping tab 320*b*. The vertical stopping tabs 320 extend the distance 322 (FIG. 3) out of the page. Similar to the horizontal stopping tabs 300, the vertical stopping tabs 320 can be positioned or repositioned in the direction indicated by the arrows 506 (506*a*, 506*b*) as needed along the length of the collar 210.

In some embodiments, such as that shown in FIG. 1, the jib stop assembly 200*b* can be affixed to the mast 110 at the stop height 106. The stop height 106 can describe the distance from the ground surface 102 to the height along the mast at which the jib stop assembly 200*b* is mounted. In such an embodiment, the jib stop assembly 200*b* can generally be installed at or near the mast head 114 (FIG. 1). The jib stop assembly 200*b* and more particularly, the vertical stopping tabs 320 are then extend into a plane coincident with the proximal end of the jib 120 as the jib 120 swings. The vertical stopping tabs 320 can then be positioned to interfere with the rotation of the jib 120 at or near the mast head 114. Accordingly, the position of the vertical stopping tabs 320 can define an angle through which the jib 120 can have unimpeded movement. As shown in FIG. 5B, the vertical stopping tabs 320*a*, 320*b* are positioned on opposite sides of the mast 110 and the collar 210, providing approximately 180 degrees of movement for the jib 120, as indicated by the arrows 508*a*, 508*b*. In this way, the jib stop assembly 200*b* can effectively limit the angle through which the jib 120 can swing and protect nearby equipment or structures.

In some embodiments, the jib stop assembly 200*b* can have one vertical stopping tab 320 and one horizontal stopping tab 300 (not shown). This configuration can place the vertical stopping tab 320 in a plane coincident with the proximal end of the boom 130, while the horizontal stopping tab 300 extends a sufficient distance to contact the support 140 of the jib crane 100. Accordingly, multiple combinations of the horizontal stopping tabs 300 and the vertical stopping tabs 320 are possible.

Figure 6:
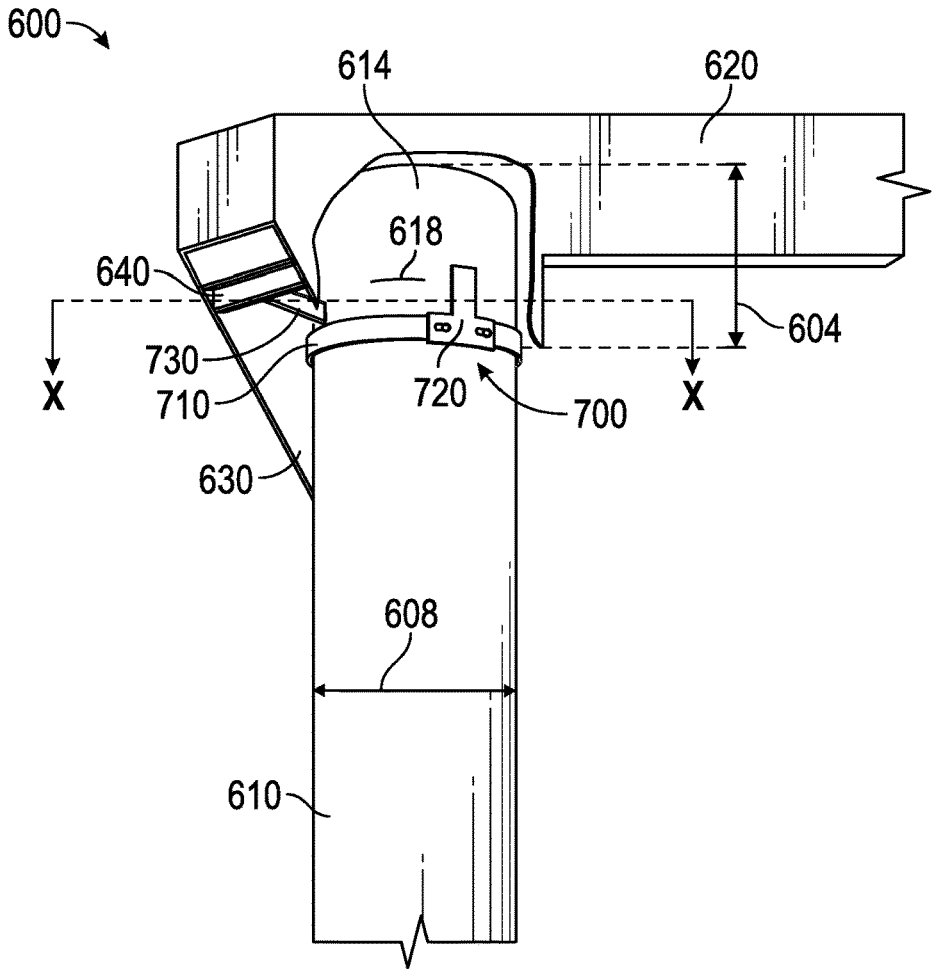
FIG. 6 is a cutaway view of a shrouded jib crane using a jib stop assembly.

FIG. 6 is a cutaway view of a shrouded jib crane using a jib stop assembly. A shrouded jib crane (jib crane) 600 can operate in a similar manner to the jib crane 100. The jib crane 600 can have a mast 610. The mast 610 can have a base (not shown) mounted to a ground surface (e.g., the ground surface 102) similar to the jib crane 100. The mast 610 can have a generally circular cross section with an outer diameter 608. The mast 610 can also have a mast head 614 operably coupled to a jib 620. The jib 620 can be similar to the jib 120 and rotate about the mast head on one or more bearings (not shown). The jib crane 600 can also have a shroud 630 that covers and protects the mechanical couplings. A portion of the shroud 630 is cut away in this figure for convenience of description. In some examples, the shroud 630 can also have a lower bearing (not shown) that allows the jib 620 to swing about the mast head 614. The shroud 630 can also provide structural support for the jib 620 under load.

The jib crane 600 can include a jib stop assembly 700. The jib stop assembly 700 can be positioned a distance 604 from the mast head, beneath the shroud 630. Accordingly, portions of the jib stop assembly 700 are shown in dashed lines indicating their position beneath the shroud 630. Much like the jib stop assemblies 200, the jib stop assembly 700 can be implemented to limit the angle through which the jib 620 can swing. This can serve to protect nearby equipment and structures, similar to above.

The jib stop assembly 700 can have a collar 710 mounted to the mast 610. The collar 710 can have one or more stopping tabs, shown as a vertical stopping tab 720 (shown in dashed lines). The jib stop assembly 700 can also have a shroud extension 730 affixed or otherwise fastened to a safety channel 640 of the shroud 630. The safety channel 640 can be a portion of C-channel welded or otherwise affixed to the shroud 630. In some embodiments, the collar 710, the vertical stopping tabs 720, and the shroud extension 730 can be the major parts of the jib stop assembly 700. Other features are described in the following figures.

Figure 7:
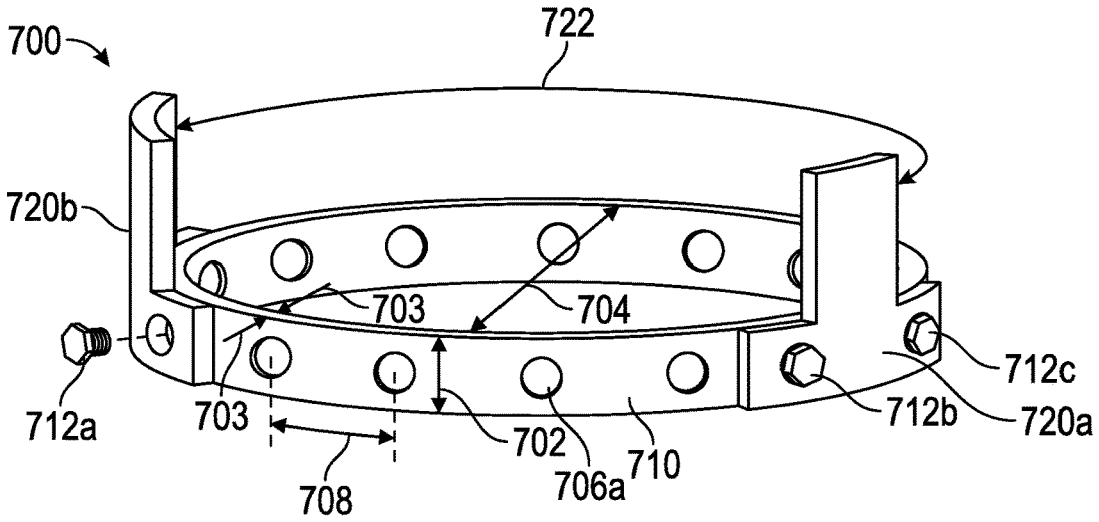
FIG. 7 is a perspective view of the collar and stopping tabs of the jib stop assembly of FIG. 6.

FIG. 7 is a perspective view of the collar and stopping tabs of the jib stop assembly of FIG. 6. The jib stop assembly 700 can have the collar 710 and one or more vertical stopping tabs 720. Two vertical stopping tabs 720*a*, 720*b* (collectively, vertical stopping tabs 720) are shown spaced on opposite sides of the collar 710 spaced an angular distance 722 apart. The angular distance 722 can described a rotational limit on the movement of the jib 620 when installed on the mast 610. In some embodiments, the vertical stopping tabs 720 can be repositioned as needed to change the angular distance 722.

In some embodiments, the collar 710 can be a round metal ring with an inner diameter 704 that is slightly larger than the outer diameter 608 of the mast 610. The collar 710 can also have a height 702 and a width 703. For example, the height 702 can be approximately one inch to three inches. In some cases, the height 702 can exceed three inches depending on the span and capacity of the jib crane 600. In some embodiments, the width 703 can be approximately a half inch. In some embodiments, the width 703 can exceed one half inch depending on the material used and the size and load requirements of the jib crane 600.

In some embodiments, the collar 710 can be formed of more than one collar portion, (similar to the first collar portion 212*a* and the second collar portion 212*b* of the jib stop assemblies 200) and affixed to the mast 610 at a the desired height and distance 604 from the mast head 614. In some embodiments, the collar 710 can be affixed to the mast 610 by welding. In some other embodiments, the collar 710 may be unitary piece that can be installed over the mast 610, for example, prior to attaching the jib 620 to the mast head 614. In some other embodiments, the collar 710 can be installed during manufacturing of the jib crane 600.

In some embodiments, the collar 710 can be formed with a plurality of collar apertures 706. The collar apertures 706 can be oriented radially about the collar 710. Fourteen collar apertures 706 are shown in this figure with one aperture 706 hidden by the perspective behind the vertical stopping tab 720*a*. Not all of the collar apertures 706 are labeled for brevity. In some embodiments, the number of apertures can be larger or smaller than that shown, depending on application and the outer diameter 608 of the mast 610 and the inner diameter 704 of the collar 710. Each of the collar apertures 706 can also have internal threads (not shown) formed to accept a bolt or other suitable fastener 712.

The collar apertures 706 can be evenly spaced apart by an aperture spacing 708 about the collar 710. The even spacing can allow a user to remove the fasteners 712 and quickly reposition the vertical stopping tabs 720 as needed. One of the fasteners 712*a* is shown exploded from the vertical stopping tab 720*a*. Similar to above, the fasteners 712 can be half-inch steel bolts, for example. In some embodiments, bolts larger than half-inch can also be used depending on the load-bearing capacity and the span of the jib crane 600.

Figure 8:
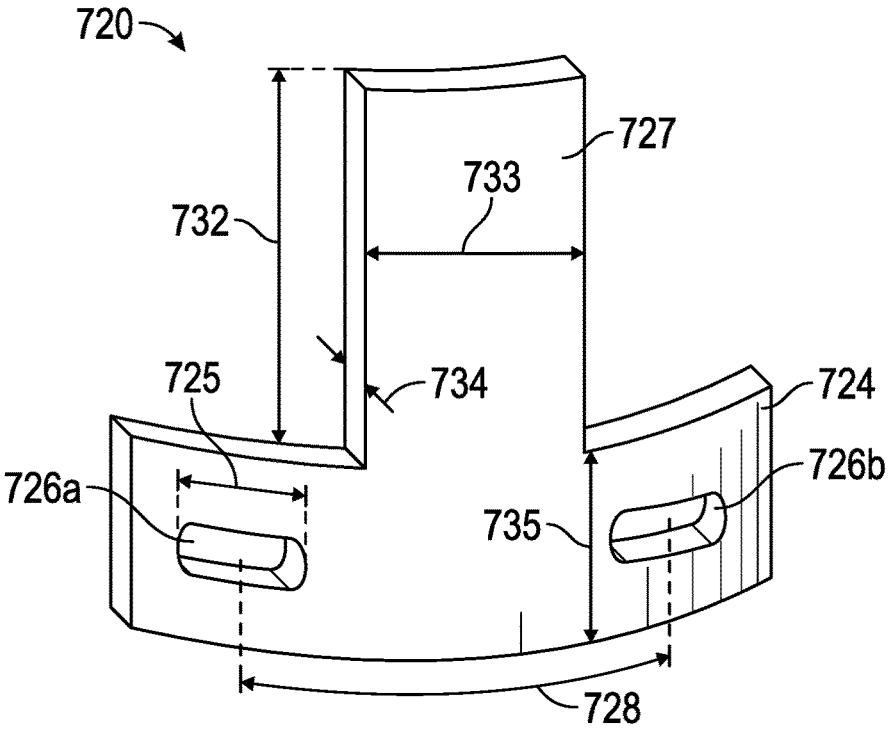
FIG. 8 is a perspective view of the vertical stopping tab of FIG. 6.

FIG. 8 is a perspective view of the vertical stopping tab of FIG. 6. The vertical stopping tabs 720 can have a tab shank 724 and a vertical arm 727, as shown. The vertical arm 727 is disposed in a generally perpendicular fashion from the center of the tab shank 724, creating an upside-down T-shape. The T-shape should not be considered limiting however. Other applicable shapes such as an L-shape or other polygons are fully contemplated in this disclosure. The T-shaped vertical stopping tab 720 can have certain structural and support advantages over other shapes, decreasing the amount of material required to ensure structural support of the jib stop assembly 700. In some embodiments, the collar 210 of the jib stop assembly 200 (FIG. 2) can be formed with apertures similar to the collar apertures 706. In such an embodiment the vertical stopping tabs 726 can be used with an embodiment of the jib stop assembly 200. In some other embodiments the horizontal stopping tabs 300 (FIG. 4A, FIG. 4B) can be formed with a shank similar to the shank 724 an incorporated into the structure of the jib stop assembly 200 configured with the collar apertures 706.

The tab shank 724 can have one or more apertures 726, shown as apertures 726*a*, 726*b*. The apertures 726 can be formed as a circular or oblong shape, sized to receive the fasteners 712. In some embodiments, the apertures 726 can be spaced apart by an aperture spacing 728. The aperture spacing 728 can be measured from the center of the aperture 726*a* to the center of the aperture 726*b*, for example. The aperture spacing 728 can be approximately equal to the aperture spacing 708. This can enable the apertures 726 to match with the collar apertures 706 facilitating installation of the vertical stopping tabs 720 on the collar 710. In some embodiments, the apertures 726 with an oblong shape can provide increased flexibility in repositioning the vertical stopping tabs 720 in various collars 710 with aperture spacing 708 that is not equal to the aperture spacing 728. In some embodiments, the oblong shape can further allow installation of the vertical stopping tabs 720 allowing some horizontal movement to fine-tune the angular swing limits (e.g., the angular distance 722) for the jib 620. In some other embodiments, the apertures 726 can have internal threads matching the external threads of the fasteners 712. In some other embodiments, the apertures 726 can be countersunk to receive fasteners 712 to with a tapered head, decreasing the profile of the vertical stopping tab 720 when installed under the shroud 630. This is similar to the fasteners 220 (FIG. 2)

The vertical arm 727 can extend a tab height 732 away from the tab shank 724. The tab height 732 can measure one to three or more inches depending on the application. In some embodiments, the tab height 732 can be as much as 5 inches, depending on the placement of the safety channel 640. The vertical and horizontal distance between the shroud extension 730 and the placement of the collar 710 can determine a need for a longer or shorter tab height 732.

The tab shank 724 can have a shank height 735. In some embodiments, the shank height 735 can be approximately equal to the collar height 702 (e.g., one half inch to more than two inches). The vertical arm 727 and the tab shank 724 can also have a thickness indicated by the arrows 734 (thickness 734). The thickness 734, similar to above, can be approximately one half inch. The thickness 734 as well as the width 703 can be limited by the amount of space provided between the mast 610 and the shroud 630. In some embodiments, space can be limited to little more than one inch. Accordingly, careful selection of materials and dimensions can be required. The tab height 732 and the thickness 734 can be dependent on the application of the vertical stopping tab 720 and the positioning on the mast 610 and available space under the shroud 630. In some embodiments, the area beneath the shroud is limited requiring, for example, a longer or thinner vertical arm 727.

Figure 9A:
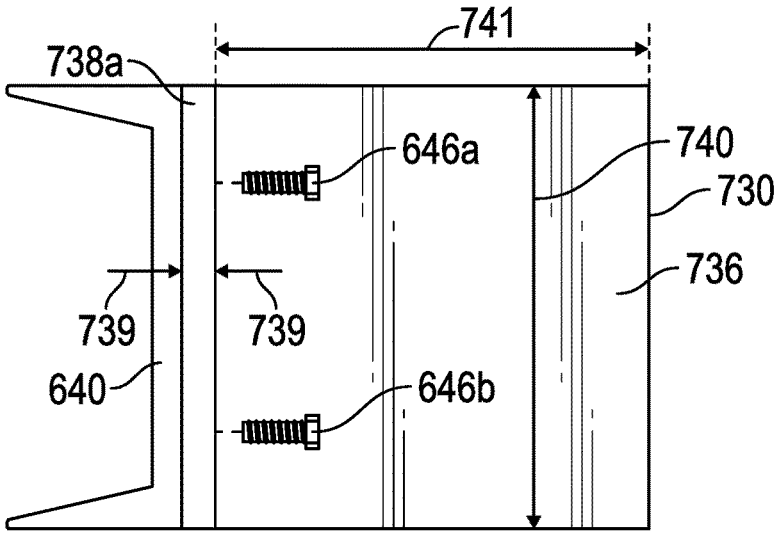
FIG. 9A is an elevation view of the shroud extension and safety channel of FIG. 6.

FIG. 9A is an elevation view of the shroud extension and safety channel of FIG. 6. The shroud extension 730 can have an extension arm 736 and at least one flange 738 disposed perpendicular to the extension arm 736. The flanges 738 (FIG. 9B) can be fastened or affixed to the safety channel 640 of the shrouded jib crane 600 (FIG. 6). The safety channel 640 can be a portion of C-channel disposed between opposite sides of the shroud 630. The flanges 738 of the shroud extension 730 can be affixed to the safety channel 640 such that the extension arm 736 extends away from the safety channel 640 and toward the mast 610. As will be described in greater detail below, the extension arm 736 can extend away from the safety channel 640 to come in contact with the vertical stopping tab 720 to limit the angular movement of the jib 620.

In some embodiments, the safety channel 640 can be formed with apertures corresponding to apertures formed in the flanges 738 of the shroud extension 730. Fasteners 646 can be inserted through the apertures in the flanges 738 and into the corresponding apertures in the safety channel 640 and used to secure the shroud extension 730 to the safety channel 640. In some embodiments, the shroud extension can be affixed to the safety channel 640 via a variety of welding, adhesives, or mechanical fasteners such as rivets. The fasteners 646 are shown in this figure, for example, as bolts.

In some embodiments, the shroud extension can have a height 740 and a length 741. The length 741 can be two to three inches for a small application to more than four inches in a larger application. Similar to above, the composition and size of the shroud extension 730 can be predicated on the amount of available space under the shroud 630. This can be, of course, manufacturer-specific. The safety channel 640 can also have a channel height 742 (FIG. 9B) similar to the height 740. The safety channel 640, depending on the manufacturer, can have different size and placement. In some embodiments, the channel height 742 of the safety channel 640 can be three to four inches.

Figure 9B:
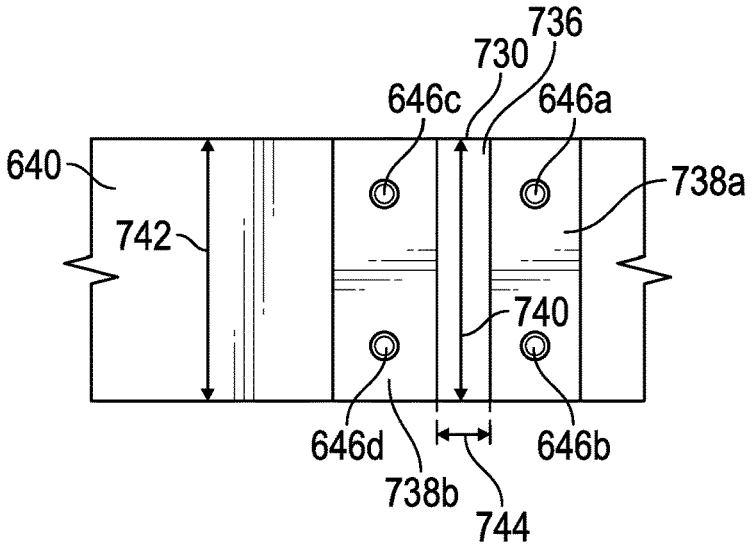
FIG. 9B is another elevation view of the shroud extension and safety channel of FIG. 6.

FIG. 9B is another elevation view of the shroud extension and safety channel of FIG. 6. In this figure, the shroud extension 730 and the safety channel 640 are shown as would be viewed in a perspective looking away from the mast 610. The apertures 643 (FIG. 9A) of the flanges 738 can be can be coincident with the apertures 642 (FIG. 9A) of the safety channel 640. Fasteners 646 (shown as fasteners 646*a*, 646*b*, 646*c*, 646*d* can then be used to secure the shroud extension 720 in place on the safety channel 640 as noted above. In some embodiments, the fasteners 646 can be bolts or screws. In some other embodiments, the fasteners 646 can be rivets. In still other embodiments, the shroud extension may be permanently or semi-permanently affixed via a weld or other bond.

Figure 10:
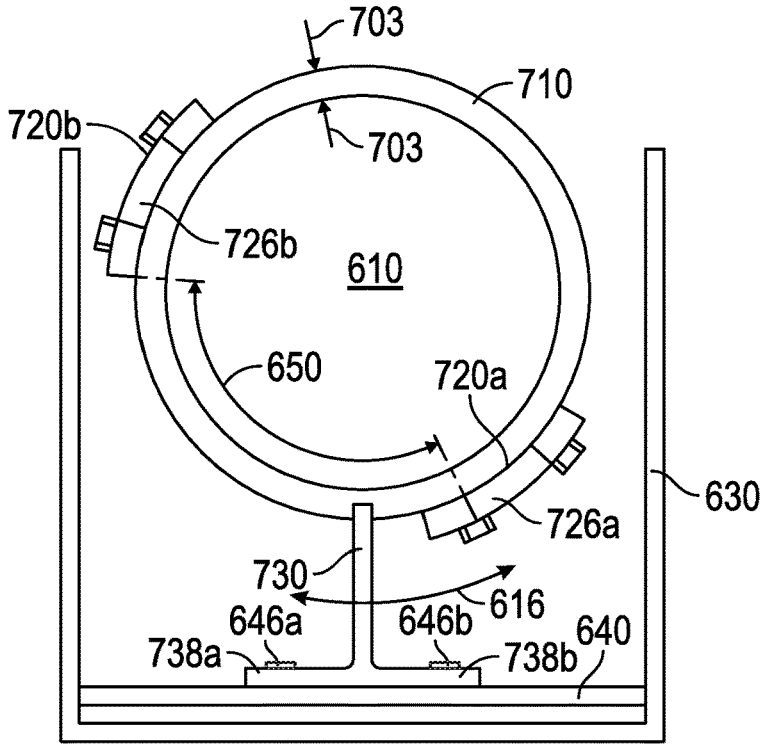
FIG. 10 is a cross-sectional view of the shrouded jib crane and jib stop taken along the line X-X of FIG. 6.

FIG. 10 is a cross sectional view of the shrouded jib crane and jib stop taken along the line X-X of FIG. 6. As shown, the collar 710 can be mounted to the outer surface of the mast 610. Two vertical stopping tabs 720*a*, 720*b* can be engaged with the collar 710 to define an angle 650 through which the shroud extension 730 is allowed to move. In some embodiments the vertical stopping tabs 720 are engaged with the collar 710 using mechanical fasteners, such as the fasteners 712. In some other embodiments, other varieties of mechanical means such as rivets, screws, or bolts can also be used. In some other embodiments, the vertical stopping tabs 720 can be engaged with the collar 710 and the collar apertures 706 using an interference connection.

As the jib 620 rotates about the mast 610, the shroud extension 730 can come in contact with the vertical stopping tab 720*a* or the vertical stopping tab 720*b* depending on which direction the jib 620 swings. The vertical stopping tabs 720 can then impede the jib 620 from swinging past the selected position. In some embodiments, the fasteners 712 can be removed; the vertical stopping tab 720 can be moved to a new location and refastened in the new location using the same fasteners 712.

The preceding detailed description is merely exemplary in nature and is not intended to limit the invention or the application and uses of the invention. The described embodiments are not limited to use in conjunction with a particular type of machine. Hence, although the present disclosure, for convenience of explanation, describes a jib stop various types of jib cranes, it will be appreciated that the jib stop in accordance with this disclosure can be implemented in various other configurations and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A device for limiting a swing angle of a jib crane, the jib crane having a jib rotatably mounted to a mast, the device comprising:

a collar configured to be fit to the mast at a stop height, the collar having, a collar height and a collar width, a first collar portion having a first joint end and a first clamp end, a second collar portion having a second joint end and a second clamp end, a joining plate operable to secure the first joint end to the second joint end about the mast; and a clamp fastener configured to compress the first clamp end toward the second clamp end and decrease an inner diameter of the device sufficiently to secure the device to the mast; and one or more stopping tabs enagagable with the collar and adjustable on the collar at one or more points about a circumference of the mast, the stop height placing the one or more stopping tabs in a position configured to interfere with the jib to limit the swing angle of the jib.

2. The device of claim 1, wherein:

the first clamp end has a first flange disposed orthogonally to the first clamp end;

the second clamp end has a second flange disposed orthogonally to the second flange end, the first collar portion and the second collar portion having a semi-circular shape; and the first collar portion and the second collar portion configured to surround the mast when engaged with the joining plate.

3. The device of claim 1, wherein the collar has an inner diameter configured to be larger than an outer diameter of the mast and configured to be slidably fit about the mast.

4. The device of claim 1, wherein the collar further comprises a rubber pad on an inner surface of the collar.

5. The device of claim 1, the one or more stopping tabs comprising at least one vertical stopping tab, the at least one vertical stopping tab having:

a first tab body having a first tab aperture, the first tab aperture being sized to receive the first joint end or the second joint end and configured to allow the vertical stopping tab to be adjustably positioned along a length of the first collar portion or the second collar portion; and a vertical tab arm coupled to the first tab body and extending from the collar a vertical tab height, placing the vertical tab arm at a position configured to be coincident with the jib, the vertical tab arm being configured to interfere with angular movement of the jib and define an angle through which the jib can swing.

6. The device of claim 1, the one or more stopping tabs comprising at least one horizontal stopping tab, the at least one horizontal stopping tab having:

a second tab body having a second tab aperture, the second tab aperture being sized to receive the first joint end or the second joint end and configured to allow the at least one horizontal stopping tab to be adjustably positioned along a length of the first collar portion or the second collar portion, and a horizontal tab arm coupled to the second tab body and extending away from the collar a horizontal distance, placing the horizontal tab arm at a position configured to be coincident with a portion of the jib, the horizontal tab arm being configured to interfere with an angular movement of the jib and define an angle through which the jib can swing.

7. The device of claim 1, wherein the collar height is one to three inches.

8. The device of claim 1, wherein the collar has a collar thickness of one quarter to three quarters of one inch.

9. A method for limiting a swing angle of a jib crane, the jib crane having a jib rotatably mounted to a mast, the method comprising:

determining a stop height on the mast coincident with a portion of the jib;

securing a collar at the stop height on the mast, the collar configured to be slidably fit around the mast, the collar having, a collar height and a collar width, a first collar portion having a first joint end and a first clamp end, a second collar portion having a second joint end and a second clamp end, a joining plate operable to secure the first joint end to the second joint end about the mast, and a clamp fastener configured to compress the first clamp end toward the second clamp end and decrease an inner diameter of the device sufficiently to secure the device to the mast;

engaging one or more stopping tabs with the collar, the sopping tabs being adjustable to one or more points about a circumference of the mast, the stop height placing the one or more stopping tabs in a position configured to interfere with the jib; and limiting an effective swing angle of the jib based on the one or more points.

10. The method of claim 9, further comprising securing the collar to the mast using the clamp fastener.

11. The method of claim 9, further comprising:

engaging the joining plate with the first joint end and the second joint end wherein the first collar portion and the second collar portion are configured to surround the mast when engaged with the joining mechanism;

engaging the clamp fastener with the first clamp end and the second clamp end; and securing the collar to the mast at the stop height with the clamp fastener.

12. A device for limiting a swing angle of a jib crane, the jib crane having a jib rotatably mounted to a mast, the device comprising:

a first collar portion having a first joint end and a first flange end, the first flange end having a first flange disposed orthogonally to the first flange end;

a second collar portion having a second joint end and a second flange end, the second flange end having a second flange disposed orthogonally to the second flange end, the first collar portion and the second collar portion having a semicircular shape;

a joining plate engageable with the first joint end and the second joint end wherein the first collar portion and the second collar portion are configured to surround the mast to form a collar when engaged with the joining plate; and one or more stopping tabs configured to engage with the collar and be adjustably positioned at one or more points around the collar, the one or more stopping tabs being in a position configured to interfere with the jib so as to limit a movement of the jib to an angle determined by the stopping tabs.

* * * * *